US005502933A

United States Patent [19]

Skillern

[11] Patent Number: 5,502,933

[45] Date of Patent: Apr. 2, 1996

[54] MODULAR STAIRCASE SYSTEM

[76] Inventor: Charles T. Skillern, 3150 Lanier Dr., Atlanta, Ga. 30319

[21] Appl. No.: 165,359

[22] Filed: Dec. 10, 1993

[51] Int. Cl.[6] ..... E04F 11/00

[52] U.S. Cl. ..... 52/182; 52/187

[58] Field of Search ..... 52/182, 187, 188, 52/183, 186, 741

[56] References Cited

U.S. PATENT DOCUMENTS

| | | | |
|---|---|---|---|
| 3,196,997 | 7/1965 | Hager | 52/182 |
| 3,474,882 | 10/1969 | Ernst . | |
| 4,296,577 | 10/1981 | Schuette . | |
| 4,373,609 | 2/1983 | DeDonato | 52/187 X |
| 4,422,270 | 12/1985 | Lapointe et al. | 52/182 |
| 4,557,085 | 12/1985 | Yamazaki . | |
| 4,850,164 | 7/1989 | McLeod . | |
| 5,014,475 | 5/1991 | Anderson, Jr. et al. | 52/182 X |
| 5,163,491 | 11/1992 | Smith . | |
| 5,347,774 | 9/1994 | Smith . | |
| 5,402,610 | 4/1995 | Salvá et al. . | |

*Primary Examiner*—Creighton Smith
*Attorney, Agent, or Firm*—Hardaway Law Firm

[57] ABSTRACT

An "off the shelf" modular staircase system is described that allows for a flexible fit of the staircase into custom plan areas and/or areas in which the ceiling-to-floor height varies. The modules form a complete staircase and not a mere skeleton of a staircase. Furthermore, the modular staircase system, because it allows for the mass production and conventional transportation of the various stair modules, results in the reduced cost of a staircase and reduced construction time. Individual stair modules may be formed as a unitary structure out of a moldable material.

7 Claims, 6 Drawing Sheets

MODULAR STAIRCASE SYSTEM

BACKGROUND OF THE INVENTION

Staircase are composed of curved step segment(s) having a curved inside radius of a first positive value and a curved outside radius of a second positive value larger than the first. Staircases are know to be either "supported", i.e., supported by the walls underneath the staircase or "free-standing", i.e., attached to the building structure only at the top and bottom of the staircase.

Staircases are constructed within a cube of space defined by plane limitations composed of three axes: X, Y, and Z. The X axis is the horizontal plane. The Y axis is the vertical plane. The Z axis is the vertical space, which is equal to the finished floor-to-ceiling height. The Z axis is unpredictable in residential construction because of the use of various floor-to-ceiling heights and variation in the thicknesses of floor finishing materials and floor structural options.

Finally, staircase are constructed within various building code limits. These building codes limit: rise (the vertical distance between adjacent steps), the variation of one rise to another in the same staircase, run (horizontal distance between steps), and variation of one run to another in the same staircase.

DESCRIPTION OF THE PRIOR ART

The prior art method of installing staircases has many disadvantages. First, because every staircase is unique due to the variation in the Z axis, there is no way to reduce costs by implementing mass production manufacturing methods in the staircase industry. Accordingly, the completed staircase is expensive. Second, substantial time is lost in the building process itself, because it takes a much longer lead time to build a staircase from scratch as opposed to merely constructing a staircase out of modular preformed components. This is due to all the operations required, such as: job measurements, shop drawings and customer approval of the drawings, manufacturer job phasing, fabrication and construction, delivery, and installation. Third, one-piece staircases are large, bulky, and difficult to handle. Typically, a completed curved staircase crate is 4'X 7'X 16'.

It has been attempted in the prior art to alleviate these problems through the use of modular staircase systems. These attempts, however, still have their faults.

For example, U.S. Pat. No. 3,474,882, to Ernst and U.S. Pat. No. 4,296,577, to Schuette, show attempts at making modular staircases. However, in these patents the rises between steps are not easily adjusted like in the instant invention. In these patents, to change the rises between steps, studs of varying heights or shims of various thicknesses, respectively, would have to be changed. This requires a supply of studs or shims to be nearby.

U.S. Pat. No. 4,373,609, to De Donato and U.S. Pat. No. 4,850,164, to McLeod, also show modular staircases. However, in these patents the rises between steps are not adjustable at all. Furthermore, the patents to Schuette and De Donato do not form staircases, per se. These two patents really produce skeletons of staircases.

While the above-mentioned prior art is a good starting point, they have many other deficiencies besides those described immediately above. For example, none of these patents appear to mix and match straight and curved stair modules to form staircases of varying configurations. Furthermore, none of these patents appear to allow for automated manufacturing methods to be used in order to construct the individual stair modules.

Therefore, there is ample room for improvement in the field of modular staircases.

SUMMARY OF THE INVENTION

The modular staircase 5system according to the invention eliminates or at least greatly reduces the impact of traditional problems found in the prior art construction of staircases. The invention allows for a manufacturer to mass produce staircase ("stair" or "tread") modules in three shapes: straight, curved, and bullnose. A builder, based on the type of staircase to be built, i.e., straight, curved, or spiral, and the expected floor-to-ceiling distance then orders the number and combination of modules required to produce that staircase. The builder then installs the staircase with any fluctuations in floor-to-ceiling distance compensated for by the adjustment of the step-to-step rise allowed by the structure of the modular staircase according to the invention.

OBJECTS OF THE INVENTION

It is, therefore, an object of the invention to create a substantial market in the prefabrication of staircases.

It is a further object of the invention to be able to mass produce one-piece stair modules by using automated manufacturing methods and molding machines in the construction of staircases.

It is a further object of the invention to greatly reduce the time required in ordering and constructing a staircase.

It is a further object of the invention to reduce the effect of floor-to-ceiling height variances in the construction of a staircase.

It is a further object of the invention to reduce the skill level required to build a staircase from the advanced level required to "field build" a prior art staircase to the low level required to "field assemble" the instant modular staircase.

It is a further object of the invention to reduce the amount of damage to the staircase installed early on into the building by allowing for a rough tread Surface to be covered by a finished tread surface later on in the construction process.

These and other objects of the invention are achieved by: a preformed module for forming a staircase comprising: a vertically oriented front member; a vertically oriented back member; a first horizontally oriented assembly diaphragm connecting a top of the front member to a top of the back member; and right and left side members attached to vertical ends of said front and back members.

DETAILED DESCRIPTION OF THE INVENTION

Figure 1:
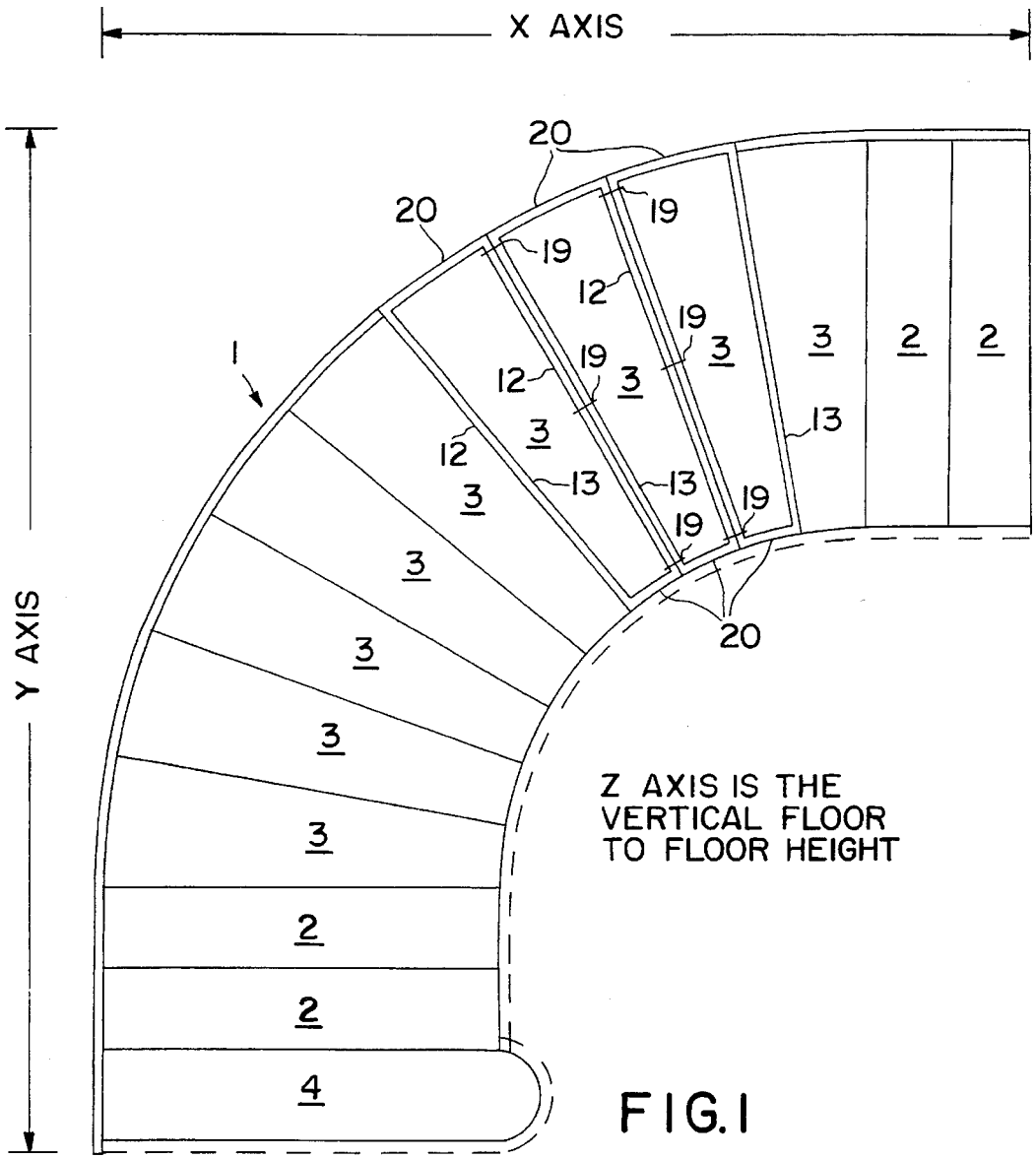
FIG. 1 is a top plan view of a curved staircase constructed out of staircase modules according to the disclosed invention.
Figure 2B:
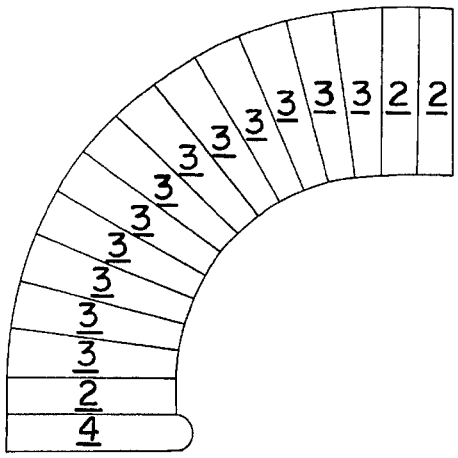
FIGS. 2*a*–2*e* are plan Views of how staircase modules can be arranged.
Figure 2A:
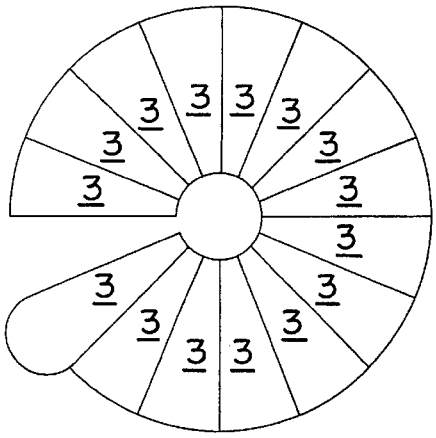
Figure 2E:
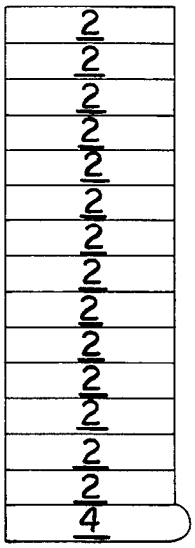
Figure 2D:
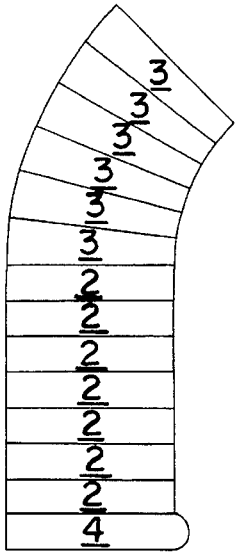
Figure 2C:
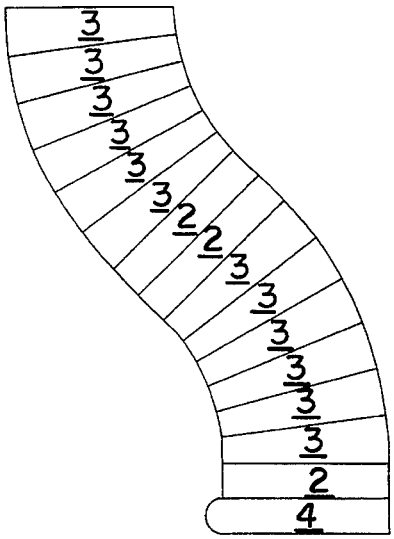

FIG. 1 shows a staircase 1 constructed according to the invention. While this particular staircase is a 90° curved staircase, as shown in FIG. 2, the staircase 1 can be either a straight, curved, or spiral staircase because of the flexibility allowed by the modular design. This exemplary staircase 1 is constructed by joining: four straight modules 2, nine curved modules 3, and one bullnose module 4. A straight staircase would be made by only using straight modules 2 and a spiral staircase would be made by using only curved modules 3. Thus, a curved staircase is defined as any staircase having curved stair modules 3 and at least one straight stair module 2. Examples of various curved staircases are shown in FIGS. 2*b*–2*c*. The use of bullnose ("starter") modules 4 is entirely optional.

Furthermore, the inside and outside radii dimensions of the curved module(s) are manufactured with fixed dimensions, in relation to each other (width of fixed tread), of any values desired. Additional flexibility in the X and Y axes can be achieved by manufacturing the curved modules in more than one size. For example, the curved modules can be manufactured as follows:

| INSIDE RADIUS | OUTSIDE RADIUS | WIDTH OF TREAD |
|---|---|---|
| 28 ¼" | 70 ¾" | 42 ½" |
| 39 ¾" | 82 ¼" | 42 ½" |
| 51 ¼" | 93 ¾" | 42 ½" |
| 62 ½" | 105" | 42 ½" |
| 74" | 116 ½" | 42 ½" |

Figure 3:
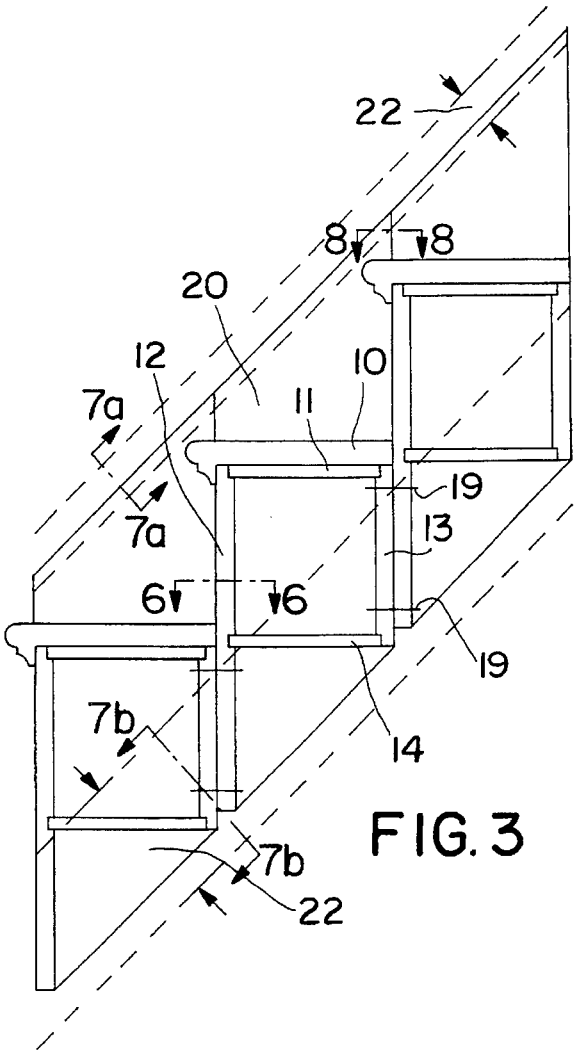
FIG. 3 cross section side view of a portion of a supported staircase showing in detail how three staircase modules are attached to each other.
Figure 8:
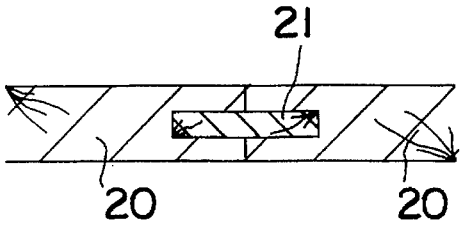
FIG. 8 is a view along line 8—8 of FIG. 3.

FIG. 3 shows the details of individual stair modules. Typically, each module is made of multiple wood planks. Each module has a finished tread.10 attached to and supported by an upper assembly diaphragm 11 which itself is supported on top ends of both a front riser panel 12 and a back riser panel 13. The upper assembly diaphragm 11 also acts as a temporary tread during the building construction process. A lower optional assembly diaphragm 14 connects a bottom of the back riser panel 13 with a point substantially midway between the top and a bottom of the front riser panel 12. This increases dimensional accuracy and structural rigidity. Furthermore, forming left and right side walls of the stair module are rhomboidal-shaped side stringer panels 20 having alignment splines 21 (FIG. 8). These side stringer panels 20 have angular edges following the rake of the staircase. These panels 20 are curved when they are used in curved modules. Thus, according to this structure, these stair modules are substantially complete stairs, in the sense that they are not mere skeletons of a staircase as in prior art patents such as U.S. Pat. No. 4,296,577, to Schuette and U.S. Pat. No. 4,373,609, to De Donato.

Figure 13B:
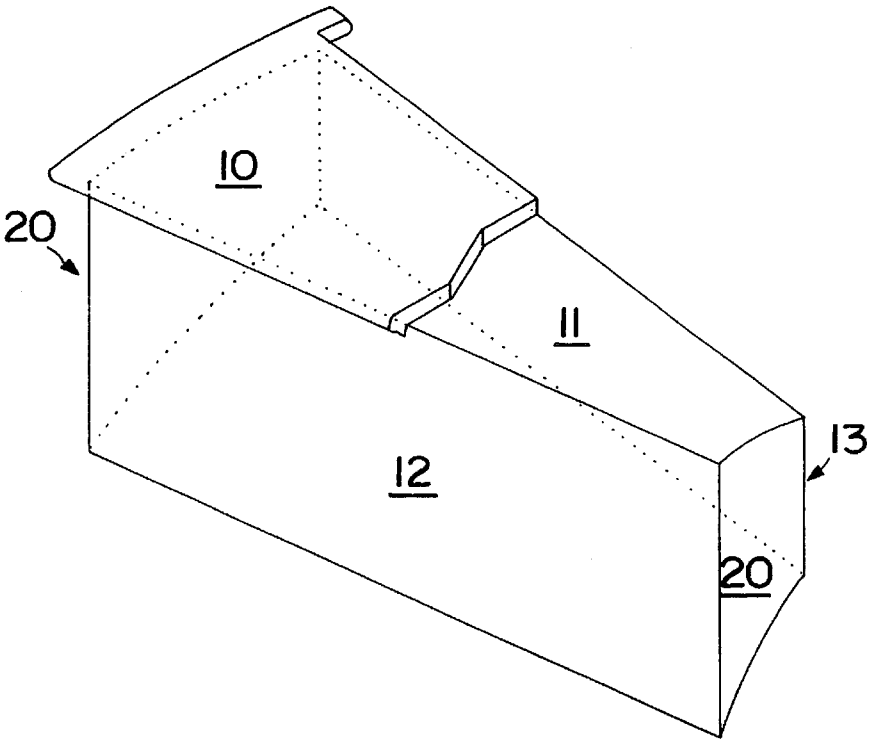
FIG. 13 is a perspective view, partial cutaway, of an alternative embodiment of a stair module according to the disclosed invention.
Figure 13A:
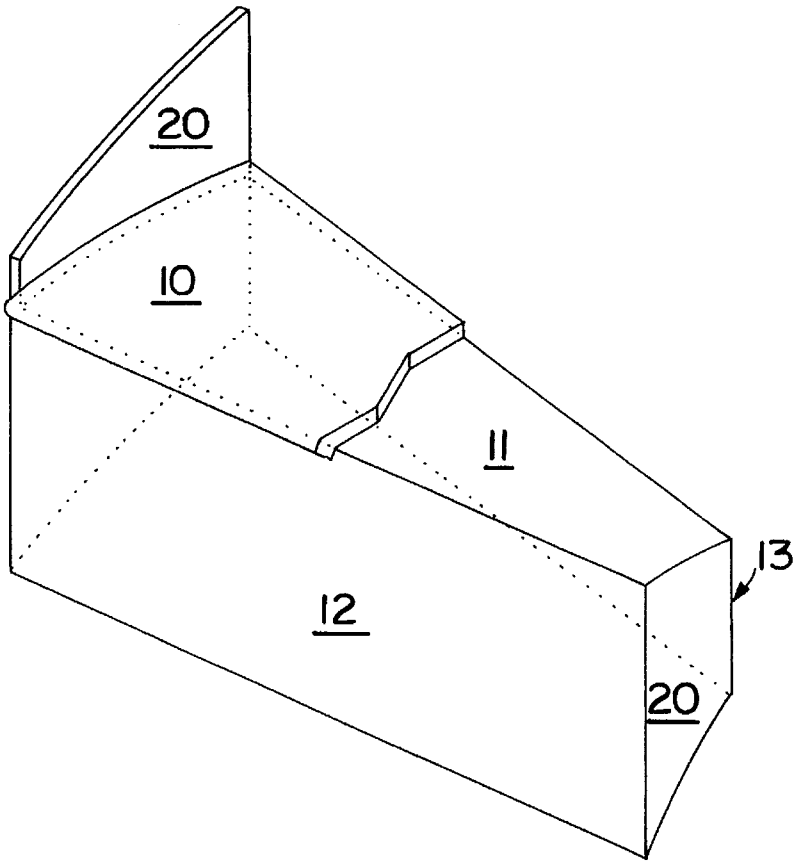

An alternative to the multi-part wood step construction described above is shown in. FIG. 13*a* (supported version) and FIG. 13*b* (free-standing version). It is conceived that the step modules can be constructed as a unitary structure out of any moldable material such as, but not limited to, fiberglass or a composite material. In this embodiment, the upper assembly diaphragm 11, the front riser panel 12, the back riser panel 13, and the left and right side walls, as described above, form one unitary stair module. The finishing tread 10 is all that would be non-unitary with the rest of the step and would be nailed or glued to the unitary stair module. This one-piece structure creates an even easier method of mass producing the individual stair modules because now automated manufacturing methods and molding machines can be used by the stair module manufacturer. This embodiment also requires substantially less construction time and effort than the skeleton staircases shown in, prior art patents such as U.S. Pat. No. 4,296,577, to Schuette and U.S. Pat. No. 4,373,609, to De Donato because there is less to construct. Finally, this one-piece construction creates a much more appealing looking staircase due to the neat lines and edges resulting from the unitary and molded construction.

To attach two stair modules together and adjust for the desired rise height, the two modules are aligned so that the desired rise height is achieved while maintaining the top edge of the front riser panel 12 parallel to the top edge of the back riser panel 13 of the adjacent module. Panels 12 and 13 are temporarily secured, under the modules, with "C" clamps. Multiple attaching members 19, such as drywall screws, are then driven through the front riser panel 12 of the upper module and the back riser panel 13 of the lower module simultaneously. This method of attaching the stair modules together is equally applicable to the both the multi-piece and one-piece embodiments of the invention. Furthermore, how a particular rise height is determined will be described below.

Figure 4:
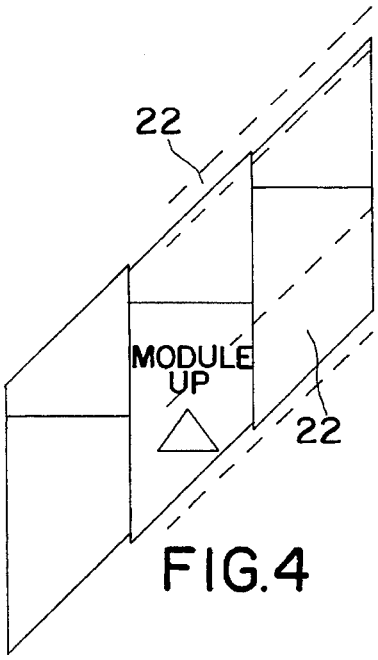
FIGS. 4 and 5 are schematic side views showing the portion of the staircase of FIG. 3, except the rise between steps are lowered and increased, respectively.
Figure 5:
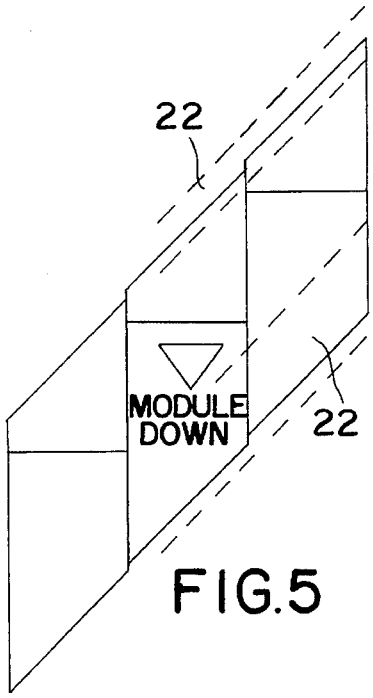
Figure 6:
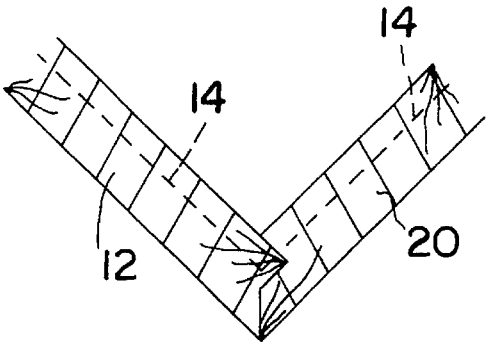
FIG. 6 is a view along line 6—6 of FIG. 3.
Figure 7A:
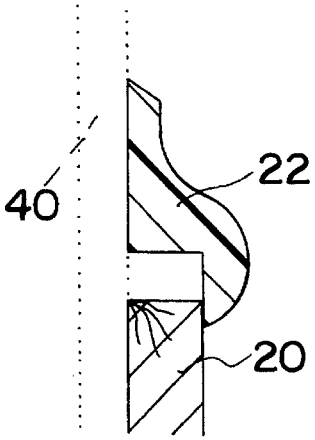
FIGS. 7*a* and 7*b* are views along lines 7*a*—7*a* and 7*b*—7*b* of FIG. 3, respectively.
Figure 7B:
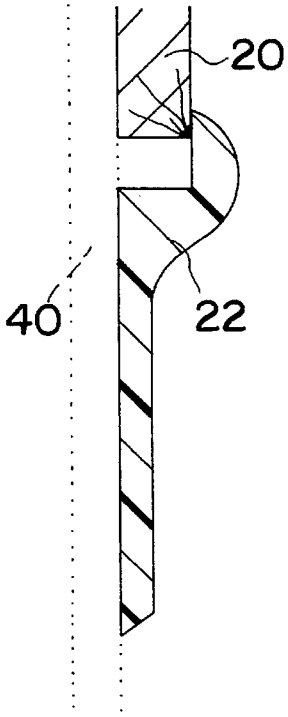

As previously described, the rise height is adjustable to an infinite number of riser heights without the need for any spacer means, such as shims of various thickness or studs of varying height. While permissible rise heights are determined by local building codes, the norm is 7"–8". Accordingly, the stair modules and side stringer panels 20 are constructed so when at a mid-point rise of 7½" inches between stairs is set, the angular edges of the side stringer panels 20 Of adjacent modules form a continuous line. However, as shown in FIGS. 4 and 5, when the rise is set at the lower limit of 7" (FIG. 4) or the higher limit of 8" (FIG. 5), the angular edges of the side stringer panels 20 of adjacent modules form a jagged discontinuous line. To eliminate the unappealing appearance created by this jagged line and to trim out the staircase to an adjacent drywall, flexible moldings 22 are used. As shown in FIGS. 7*a* and 7*b*, these flexible moldings can be attached to, for example, a sheet rock wall 40 adjacent the staircase by use of, for example, nails or glue.

To this point we have described a supported curved staircase composed of modules that would be supported by building framing underneath the assembled modules. With the addition of: two structural members 30 per module (FIGS. 9–11); a structural connecting sleeve 31; and a nut, bolt, and washer assembly 32 (FIG. 10), the resulting curved staircase can be free-standing, that is, supported only at the top and the next to the bottom modules by the building with no intermediate support.

Figure 9:
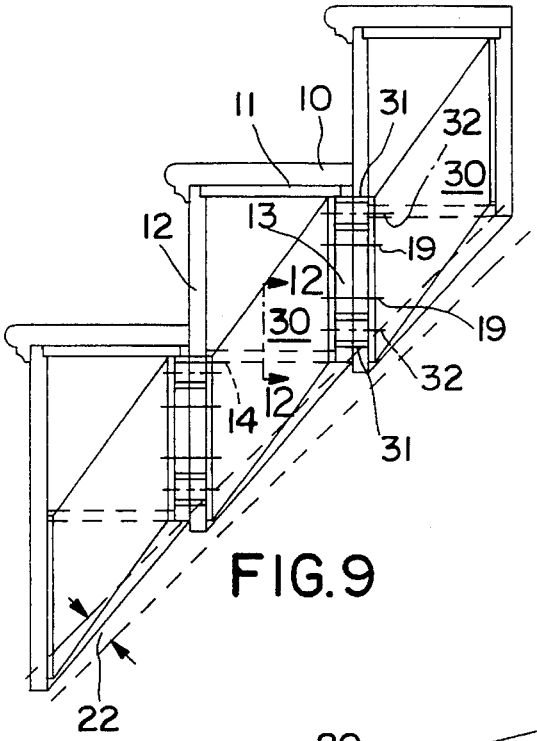
FIG. 9 is a cross section side view of a portion of a free standing staircase showing in detail how three staircase modules are attached to each other.
Figure 10:
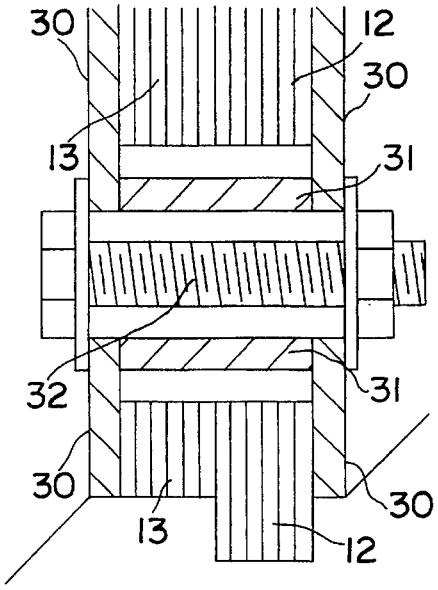
FIG. 10 is a detailed section view of the structural connection between free standing modules.
Figure 11:
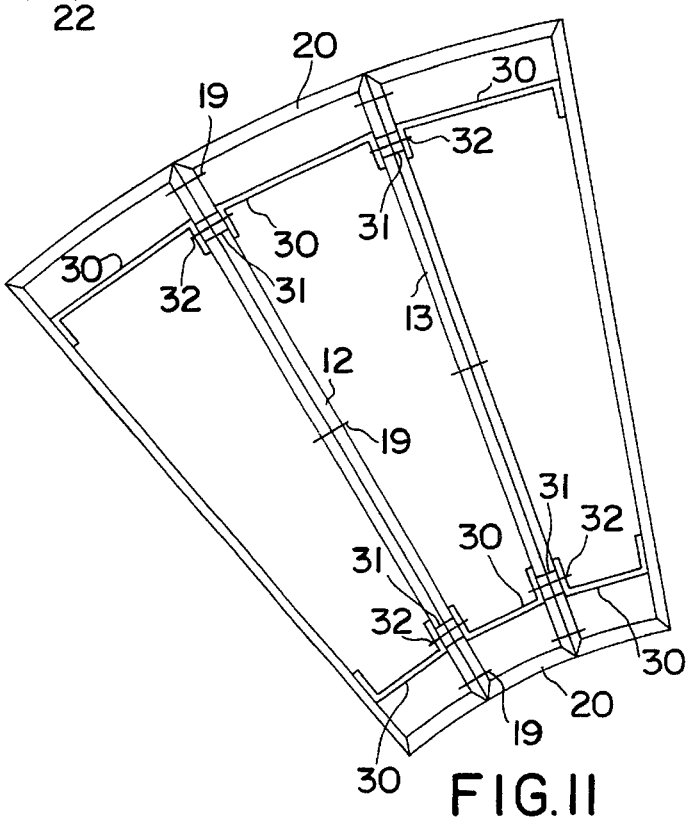
FIG. 11 is a detailed plan view of free-standing staircase modules with the structural members shown according to the disclosed invention.
Figure 12:
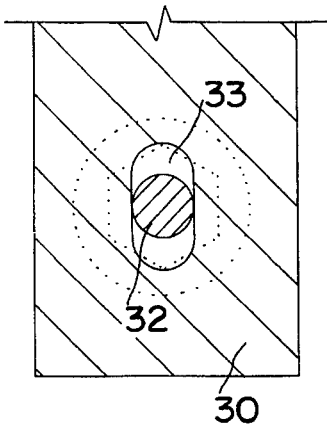
FIG. 12 is a view along line 12—12 of FIG. 9.

To install the structural members 30, a separate set of modules containing the structural components would be used. These modules, however, can be either the multi-piece or the one-piece embodiments of the stair module. FIG. 9 shows the details of these alternate modules containing the structural members. During the above assembly process, the structural connecting sleeve 31 is inserted between the modules in the position shown in FIG. 9. After the assembly of the modules has been completed as above, the structural members 30 of a given module are connected to the adjacent module structures 30 by installing the nut, bolt, and washer assembly through the structural connecting sleeve 31, and at the same time, through vertical slots 33 (FIG. 12) on the flange of the structural member 30 of the upper module. As shown in FIG. 12, the vertical slots 33 in the flanges of the structural members 30 allow passage of the bolt assembly 32 after vertical rise adjustments have been made to the modules. There are similar vertical slots made into the faces of the front riser panel 12 and the back riser panel 13 for the same vertical adjustment. The nut, bolt, and washer assembly 32 are tightened and the process is repeated for all the modules The details of this connection are shown in FIG. 10. FIG. 11 shows a plan section view of the structural components of the modules. When all modules are connected structurally as above, the resulting unit structure is secured to the building frame at the top and the next to the bottom modules. In the case of the alternative unitary structure, the structural components would be achieved by simply thickening and strengthening the side panels 20 into a beam structure. The front panels 12 and the back panels 13 would be similarly thickened and strengthened to provide for bolting securely the front panel 12 to the adjacent back panel 13.

Now that the structure of the modular staircase system has been described, how a particular rise height is calculated and how this modular structure is incorporated into a building will be described.

Assume a builder wants to install a supported curved staircase into a building he is constructing. When the builder has framed and dried in the structure, he would evaluate the space he has available (X,Y,Z axes) for a curved staircase. The builder determines, we will assume, that the 15-rise staircase shown in FIG. 1 will fit his allowed lateral space (X,Y axes) assuming he could adjust the rise height to meet the required code limits (say between 7" and 8") (Z axis). He would order: an appropriate length of flexible molding, one bullnose stair module, nine curved stair modules, and four straight stair modules. The builder measures the floor-to-ceiling height to be 114 ⅜", and thereby determines that a rise height of 7 ⅝" is required (114 ⅜" divided by 15 rises) to assure that the finished staircase will mate flush with both the elevated floor and bottom floor of the building. The staircase is assembled, module by module, to a rise height of 7 ⅝" without the need for spacer shims or tubes, and, finally, the finished treads and flexible molding are installed, completing the staircase. No further substantial construction is required as in prior art attempts at constructing modular staircases. The builder, using "off the shelf" modules, has completed his lower cost, mass produced staircase in one or two days instead of a minimum of four weeks lead time plus the installation time required for a custom fabricated staircase.

The above description is given in reference to a modular concept staircase system. However, it is understood that many variations are apparent to one of skill in the art from a reading of the above specification and such variations are within the spirit and scope of the instant invention as defined by the following appended claims.

That which is claimed:

1. A preformed module for forming a staircase comprising:

a vertically oriented rectangular front member;

a vertically oriented rectangular back member;

a first horizontally oriented assembly diaphragm connecting a top of said back member to a top of said front member; and right and left side members attached to vertical ends of said front and back members.

2. The preformed module according to claim 1, further comprising a second horizontally oriented assembly diaphragm connecting a middle of said front member to a bottom of said back member.

3. The preformed module according to claim 1, wherein:

said front member, said back member, said first assembly diaphragm, and said right and left side members are formed into a unitary module constructed out of a moldable material.

4. A modular staircase comprising:

a plurality of identical curved stair modules; and a plurality of identical straight stair modules;

each of said curved and straight modules having a vertically oriented front member and a vertically oriented back member;

wherein: (1) a rise between any two modules is adjustable depending on where a front member of one module is connected to a back member of a second module and (2) each of said curved and straight modules further comprises an assembly diaphragm connecting a top of said back member to a top of said front member.

5. A preformed module for forming a staircase comprising:

a vertically oriented rectangular front member;

a vertically oriented rectangular back member;

a first horizontally oriented assembly diaphragm connecting a top of said back member to a top of said front member and forming a horizontal top edge; and right and left side members attached to vertical ends of said front and back members;

a support structure having two flanges, said support structure being located proximate said side members; and said first flange being mounted to said front member and said second flange being mounted to said back member.

6. The preformed module according to claim 5, wherein said first and second flanges are provided with vertically oriented slots.

7. A portion of a staircase comprising:

(a) first module comprising:

(1) a vertically oriented rectangular front member;

(2) a vertically oriented rectangular back member;

(3) a first horizontally oriented assembly diaphragm connecting a top of said back member to a top of said front member and forming a horizontal top edge;

(4) right and left side members attached to vertical ends of said front and back members; (5) a support structure having two flanges provided with vertically oriented slots; said support structure being located proximate said side members; and said first flange being mounted to said front member and said second flange being mounted to said back member;

(b) a second module identical to the first;

(c) a structural pipe spacer having a thickness equal to the combined thickness of said front and back members; and said first and second modules being joined by connectors such that said horizontal top edges are parallel;

(d) an additional connector, joining said first and second modules, passing through both the vertical slots in said flanges of said first and second modules and said structural pipe spacer.

* * * * *